United States Patent [19]

Biber et al.

[11] Patent Number: 4,822,457

[45] Date of Patent: Apr. 18, 1989

[54] METHOD OF ELIMINATING A FERN-LIKE PATTERN DURING ELECTROPLATING OF METAL STRIP

[75] Inventors: Herbert E. Biber, Murrysville Township, Westmoreland County; Chang D. Kim, Boro of Fox Chapel; Larry E. Pfister, Ross Township, Allegheny County, all of Pa.

[73] Assignee: USX Corporation, Pittsburgh, Pa.

[21] Appl. No.: 147,479

[22] Filed: Jan. 25, 1988

[51] Int. Cl.[4] ..... C25D 7/06

[52] U.S. Cl. ..... 204/28

[58] Field of Search ..... 204/28

[56] References Cited

U.S. PATENT DOCUMENTS

| | | | |
|---|---|---|---|
| 1,751,960 | 3/1930 | Veenstra | 239/590.3 |
| 1,987,962 | 1/1935 | Leupold | 299/104 |
| 2,793,993 | 5/1957 | Stock et al. | 204/206 |
| 3,563,863 | 2/1971 | Vierow | 204/28 |
| 3,591,467 | 7/1971 | Carter | 204/28 |
| 3,691,030 | 9/1972 | Stroszynski | 204/32 R |
| 3,796,643 | 3/1974 | Swalheim | 204/28 |
| 4,401,523 | 8/1983 | Avellone | 204/15 |

*Primary Examiner*—T. M. Tufariello

*Attorney, Agent, or Firm*—W. F. Riesmeyer, III

[57] ABSTRACT

A method is provided for eliminating a fern-like pattern on metal strip being electroplated with metal or metal-alloy coatings. The method includes contacting the to be plated surface of the strip with sufficient additional electrolyte solution to substantially eliminate non-uniformity of a film carried thereon from a prior treatment, such additional electrolyte being in contact with said surface for at least 0.1 second prior to and continuing until arrival of said surface at a point directly facing the adjacent edge of a first electrically energized anode within an electrolytic cell for the plating thereof.

9 Claims, 2 Drawing Sheets

FIG. 3
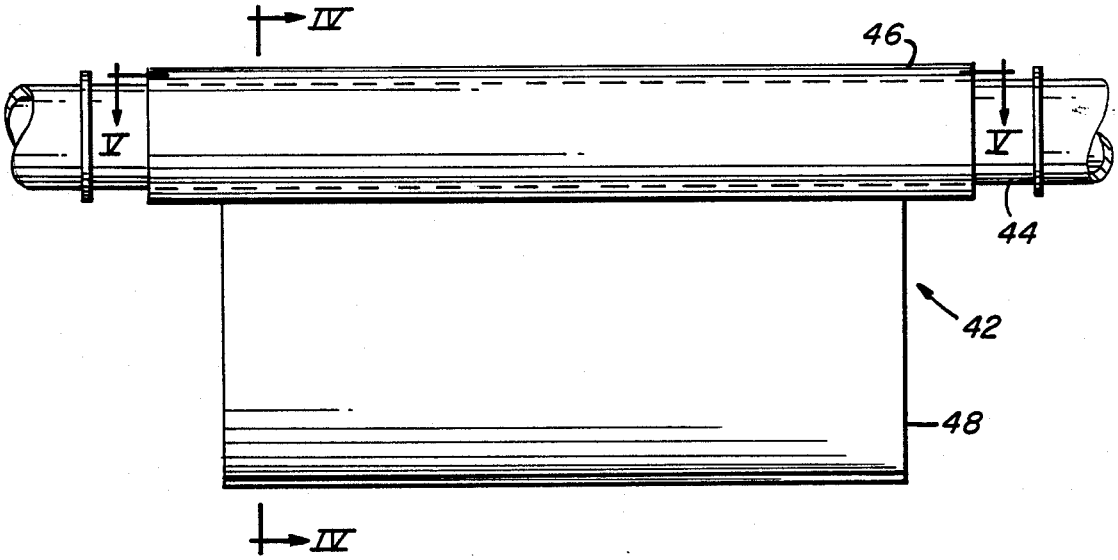
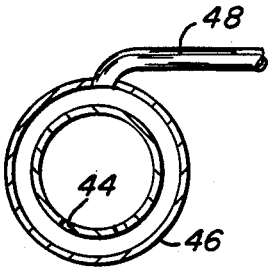
FIG. 4
FIG. 5
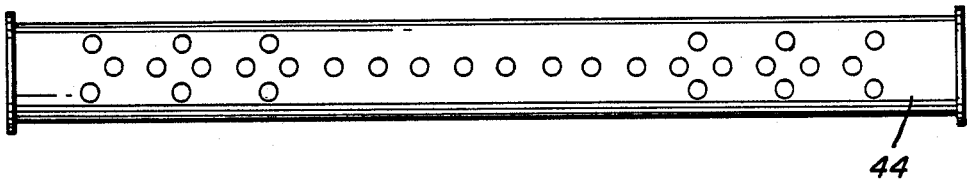
FIG. 6
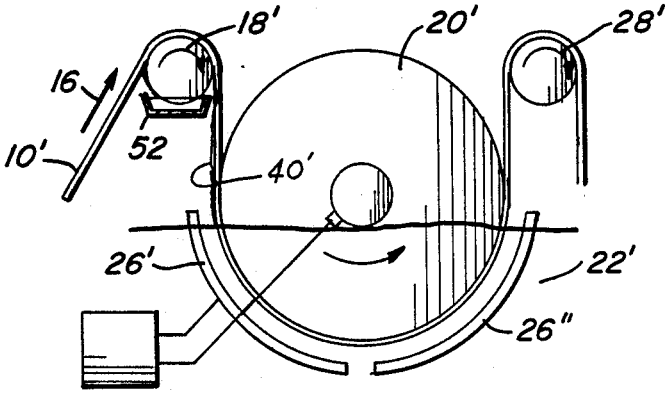

METHOD OF ELIMINATING A FERN-LIKE PATTERN DURING ELECTROPLATING OF METAL STRIP

BACKGROUND OF THE INVENTION

The present invention is related to a method for substantially eliminating a fern-like pattern on metal strip which is being treated in a series of electrolytic cells to provide an electroplated metal or metal-alloy coating thereon, and particularly to a method of applying a uniform film of electrolyte solution to a surface of the strip which is being plated for at least 0.1 second immediately prior to entry of said surface into each cell.

In the electrogalvanizing of steel strip, electrolytic cells are provided in series so that the strip is passed sequentially through the cells. Electrical current in each cell flows through a zinc-containing electrolyte solution from one or more anodes to a conductor, bonding zinc or iron-zinc alloy to the strip. The cells may be of three primary types: horizontal, vertical or radial. Between the cells, deflector rolls are provided for directing the strip upwardly out of a previous cell and downwardly into a next succeeding cell. There is a tendency for the strip to carry electrolyte solution from one cell to the next, but the deflector rolls remove most of the electrolyte by contact with the strip. Because the deflector rolls are not perfectly flat, a non-uniform layer of electrolyte passes through in gaps between the roll and the strip and is carried on the strip into the next cell. As a result, for reasons which are not completely understood, a fern-like pattern appears on the strip after electroplating. The pattern appears with greatest severity on steel having a 10 to 20% iron, balance zinc coating although it has also been noted on steel strip having a pure zinc-plated coating. In the most severe form, the pattern cannot be covered by paint of the thicknesses used on automotive body parts. For this reason, the pattern is undesirable and hinders acceptance of the product for these applications.

Various approaches have been taken in attempts to eliminate the fern-like pattern. Most of these have been directed at removing the electrolyte solution from the strip prior to its entry into a next succeeding cell after it leaves a prior one. For example, it is known to immerse a lower portion of the deflector roll in a bath of water to remove electrolyte from the roll. A showing of such a bath for immersion of a roll is contained in U.S. Pat. No. 2,793,993, Stock, at 12 in FIG. 1 thereof. It is also known to spray the strip with water both prior to and after its contact with the deflector roll. In an unrelated application, a water spray is shown at the latter location in U.S. Pat. No. 3,563,863, Vierow. Finally, wringer rolls may be provided to remove as much electrolyte as possible, again either before or after the deflector roll. None of these have proved successful in preventing occurrence of the fern-like pattern.

It is also known to pretreat the strip prior to its contact with the deflector roll for various purposes. In U.S. Pat. No. 4,401,523, Avellone, a strip conditioner station 32, FIG. 1, is provided ahead of the plating section 14. At the conditioner station a zinc sulphate spray is applied to the strip to enhance plating performance by forming a non-porous barrier film for inhibiting corrosion of the pickled and cleaned steel surface prior to plating and by acting as a seed for the plating process. The provision of concentrated electrolyte ahead of the deflector roll and maintaining a steam atmosphere around the roll is shown in U.S. Pat. No. 3,796,643, Swalheim in the electroplating of tin. This reference also discloses the use of wringer rolls 24 and water sprays 4. The application of electrolyte solution by sprays located ahead of the deflector rolls is also known in various electrogalvanizing processes. In an unrelated application, a suspension of abrasive substances in an electrolyte solution is applied after the strip passes over a deflector roll as disclosed in U.S. Pat. No. 3,691,030, Strosznski in the electrochemical oxidation of the surfaces of aluminum or zinc substrates for making lithographic printing plates. And finally, U.S. Pat. No. 3,591,467, Carter, discloses the application of a protective fluid to exclude electrolyte from the surface which is not to be plated. Header apparatus similar to that used for practicing the method of the present invention is disclosed in U.S. Pat. Nos. 1,751,960 and 1,987,962.

SUMMARY OF THE INVENTION

The primary object of this invention is to substantially eliminate a fern-like pattern on steel strip having an electroplated pure zinc or iron-zinc alloy coating by contacting the surface of the strip to be plated in the next adjacent cell of a series of cells with sufficient additional electrolyte solution to substantially eliminate non-uniformity of the electrolyte solution carried thereon from a prior treatment, said additional electrolyte solution being in contact with said surface for a time of at least 0.1 seconds prior to and continuing in contact therewith until arrival of said surface at a point directly facing the adjacent entry edge of a first electrically energized anode within said cell. The invention is particularly applicable to plating processes utilizing zinc chloride electrolyte solutions and especially those for the plating of zinc alloy coating containing 10 to 20% iron.

BRIEF DESCRIPTION OF THE DRAWINGS

FIG. 3 is an enlarged plan view of the header apparatus shown in FIG. 1.

FIG. 4 is a section taken at IV—IV of FIG. 3.

FIG. 5 is a view taken at V—V of FIG. 3.

FIG. 6 is a side elevation view of an alternate embodiment of apparatus for practicing the method of the present invention.

DESCRIPTION OF THE PREFERRED EMBODIMENT

Figure 2:
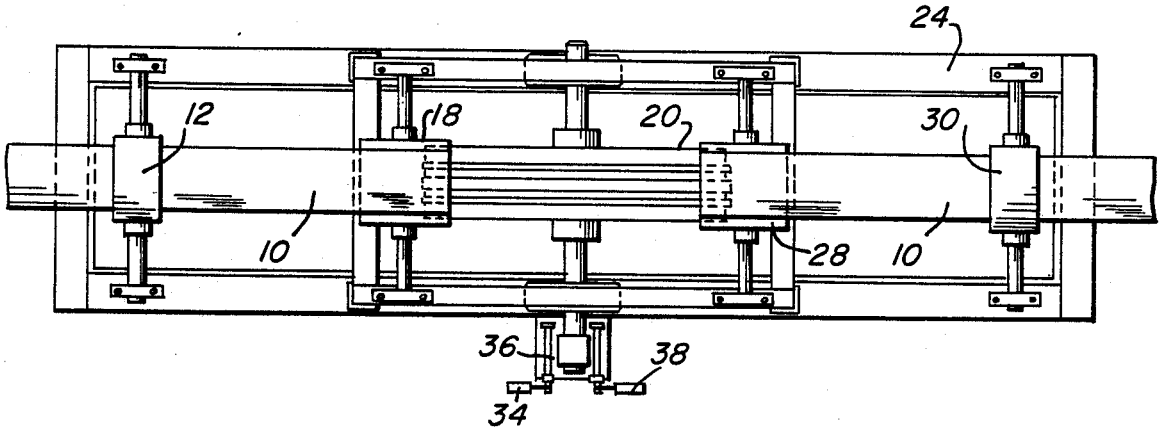
FIG. 2 is a plan view of the apparatus of FIG. 1.
Figure 1:
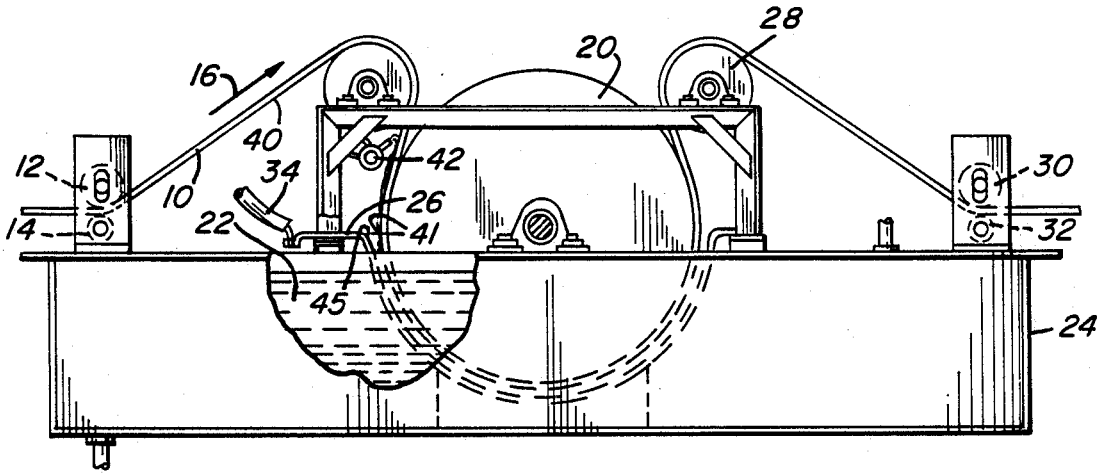
FIG. 1 is a side elevation view of a radial cell for the electroplating of metal strip together with a header apparatus for practicing the method of the present invention.

Referring to FIGS. 1 and 2, a conventional radial cell electrogalvanizing system is shown, together with a header apparatus for practicing the method of the present invention. The radial cell system is essentially the same as that described in U.S. Pat. No. 3,483,113, the specification of which is herein incorporated by reference. A steel strip 10 is passed through a pair of rolls 12 and 14 in direction 16. The strip is directed upwardly by entry deflector roll 18 and then downwardly around conductor roll 20 so as to be immersed in bath 22 of electrolyte solution contained in tank 24. The strip is carried by conductor roll 20 in close proximity to anode 26 and then upwardly over exit deflector roll 28 and downwardly through a pair of rolls 30 and 32. Electrical power is supplied from a negative side of a direct current source (not shown) by cables 34 and brushes 36 to conductor roll 20 and steel strip 10 thereon. Cable 38 connects a positive side of the direct current source to anode 26. The electrolyte solution preferably is of the zinc-chloride type for the electroplating of 10–20% Fe-Zn alloy coatings on steel strip as described in U.S. Pat. No. 4,540,472, the specification of which is incorporated herein by reference. A zinc-chloride solution of the type disclosed in U.S. Pat. No. 4,541,903, the specification of which is also incorporated herein by reference may also be used. Also, the invention is more broadly applicable to systems where sulfate or other electrolyte solutions are used and is not limited to the radial cell type system. After passing through the pair of rolls 30 and 32, the strip enters a next successive radial cell (not shown) in a series of identical cells provided for plating the strip on a surface 40 facing the anodes 26 in each of said cells.

According to one embodiment of this invention, a header apparatus 42 is provided for applying a uniform film of additional electrolyte solution to the surface 40 of the strip which is to be plated prior to entry of said surface into each cell after the strip leaves a prior cell or treatment station and subsequent to the parting of said surface with the last roll in contact therewith prior to said entry. In other words, a header is preferably provided at the location shown for each and every cell in the electrolytic plating line. It is an essential feature of the invention that the strip surface which is to be plated should not be contacted by a roll or any other member subsequent to applying the film of additional electrolyte solution and prior to entry of the strip into the electrolyte solution provided between the strip and the cathode(s) in each cell. It is also essential that sufficient electrolyte solution contacts the strip so as to substantially eliminate non-uniformity in a film carried on the strip from a prior treatment station, i.e., a prior electroplating cell or a prior conditioning treatment before electroplating, and that the electrolyte solution be in contact with the to be plated surface of the strip for at least 0.1 second prior to arrival of the surface at a point directly facing the adjacent entry edge of a first electrically energized anode within said cell. Desirably, the time of contact is at least 0.3 seconds. It should be recognized that in FIGS. 1 and 2 the anode extends above the electrolyte bath in which case the film of additional electrolyte should be in contact with the strip for at least 0.1 second before arrival of the strip at point 41 directly facing the adjacent entry edge 45 of anode 26. The anode may be completely below the bath level however, in which case the time of contact is still calculated with respect to point 41 below the level of the bath. In fact, it is conceivable that in a case where two separate anodes are provided within the bath each extending along perhaps somewhat less than 90 degrees of the periphery of roll 20, the first anode may be electrically inactive and only the second anode is used for plating. In this case, the electrolyte bath itself may provide sufficient additional electrolyte solution to substantially eliminate a non-uniform film on the strip prior to arrival at the adjacent entry edge of the first electrically active anode. Referring to FIGS. 3 and 4, header apparatus 42 includes inner pipe 44 connected at opposite ends to a source of electrolyte solution. An outer pipe 46 is sealed at opposite ends to an outer surface of inner pipe 44. Outer pipe 46 has a slot for communication with exit channel 48. A plurality of holes in a back wall of inner pipe 44 remote from channel 48 provide for the flow of electrolyte through the wall of inner pipe 44 into outer pipe 46. The electrolyte flows out of outer pipe 46 through channel 48 and provides uniform film 40 on the surface of the strip. The header is designed to provide a stream of electrolyte solution of relatively low velocity uniformly across the width of the strip. The additional electrolyte is desirably applied at a rate within the range of $1\times10^{-4}$ to $20\times10^{-4}$, more preferably $2\times10^{-4}$ to $10\times10^{-4}$ gallons per square inch of strip surface. It is desirable for the electrolyte solution to be applied at as remote a location as possible from the cell to permi sufficient time for solution to flow and form a uniform film on the strip prior to entry of the strip into the cell. The temperature and composition of the electrolyte should preferably be substantially the same as that used in each cell.

The invention is applicable to metal strip plated with zinc or zinc alloys in radial, horizontal or vertical cells but is particularly applicable when producing iron-zinc alloy coatings containing 10–20% iron on radial or vertical cell type systems. The solution may be applied by any type of apparatus for providing uniform films of liquid such as sprays, weirs, dams, etc. For example, referring to FIG. 5, the additional electrolyte may be applied by a shallow pan 52 which contains a bath for immersion of deflector roll 18' in the electrolyte to assist in providing a uniform film of electrolyte on the strip 10'. As in the prior embodiment strip 10' passes around conductor roll 20' through the bath of electrolyte 22' and upwardly over exit deflector roll 28'. In this embodiment a pair of anodes 26' and 26'' are provided in each cell. In this latter embodiment shallow pan 52 containing a bath of electrolyte 22' is effective for providing additional electrolyte at slower strip speeds only, perhaps within a range of 200 ft/min. to a maximum of about 350 ft/min. Electrolyte solution from the pan is carried upwardly on the surface of roll 18' and passes from the roll surface to the strip, providing a uniform film 40' covering the strip surface prior to its passage by anode 26'. The header of FIGS. 1 and 2 is effective for strip speeds of up to about 700 ft/min. or higher. Other embodiments within the spirit and scope of the invention will be readily apparent to those skilled in the art.

We claim:

1. A method for electroplating steel strip with zinc or zinc-alloy coatings, said method comprising:

passing the strip in sequence through a series of electrolytic cells for electroplating a surface of the strip therein, providing an electrolyte solution in each of said cells for conducting electrical current between at least one anode contained in said cell and the surface of the strip to be plated therein, said to be plated surface of the strip being contacted by at least one roll prior to entry into at least one of the cells in said series, and contacting said surface to be plated in the next adjacent cell with sufficient electrolyte solution to substantially eliminate non-uniformity of the electrolyte film carried thereon from a prior treatment, said additional electrolyte for a solution being in contact with said surface for a time of at least 0.1 seconds immediately prior to and continuing in contact therewith until arrival of said surface at a point directly facing the adjacent entry edge of a first electrically energized anode within said cell.

2. The method of claim 1 wherein said electrolyte in said cells is a zinc chloride electrolyte solution and said contacting step comprises providing additional zinc-chloride electrolyte solution on the outer surface of the last roll in contact with said to be plated surface of the strip so that said additional electrolyte solution is carried upwardly by the roll and transferred to said to be plated surface of the strip.

3. The method of claim 1 wherein said electrolyte cells are of the radial type and the electrolyte solution in said cells and the additional electrolyte comprise zinc-chloride solutions.

4. The method of claim 3 wherein said additional electrolyte solution is at a temperature within the range of 130° F. to 160° F.

5. The method of claim 1 wherein said electrolyte in the cells is a zinc-chloride electrolyte solution and said contacting step comprises flowing a stream of said additional zinc-chloride electrolyte solution onto the to be plated surface of the strip subsequent to the parting of said surface with the last roll in contact therewith prior to entry into the next adjacent cell in which said surface is to be plated.

6. The method of claim 5 wherein said additional electrolyte solution is applied at a rate within the range of $1\times10^{-4}$ to $20\times10^{-4}$ gallons per square inch of surface to be plated.

7. The method of claim 5 wherein said additional electrolyte is in contact with said surface to be plated for at least 0.3 seconds prior to arrival of said surface at a point directly facing the adjacent entry edge of said first electrically energized anode within said cell.

8. The method of claim 7 wherein said additional electrolyte solution is applied at a flow velocity within the range of 17 to 30 inches per second in a direction at an inclined angle with respect to the strip and toward the direction of travel thereon.

9. The method of claim 8 wherein said additional electrolyte is applied at a rate within the range of $2\times10^{-4}$ to $10\times10^{-4}$ gallons/in$^2$ of said surface to be plated.

* * * * *